US011479953B1

(12) United States Patent
Chandler

(10) Patent No.: US 11,479,953 B1
(45) Date of Patent: Oct. 25, 2022

(54) ANTI-BACKFLOW PLUMBING FITTING

(71) Applicant: Vista Water Group, LLC, Ashland, OH (US)

(72) Inventor: James W. Chandler, Ashland, OH (US)

(73) Assignee: VISTA WATER GROUP, LLC, Ashland, OH (US)

( * ) Notice: Subject to any disclaimer, the term of this patent is extended or adjusted under 35 U.S.C. 154(b) by 0 days.

(21) Appl. No.: 17/317,250

(22) Filed: May 11, 2021

Related U.S. Application Data

(60) Provisional application No. 63/026,790, filed on May 19, 2020.

(51) Int. Cl.
*E02C 1/10* (2006.01)
*E03C 1/10* (2006.01)

(52) U.S. Cl.
CPC ..... *E03C 1/102* (2013.01)

(58) Field of Classification Search
None
See application file for complete search history.

(56) References Cited

U.S. PATENT DOCUMENTS

| | | | |
|---|---|---|---|
| 1,362,718 | A | 12/1920 | McNamara |
| 2,047,163 | A | 7/1936 | Cekel |
| 2,071,004 | A | 2/1937 | Shanley |
| 2,134,182 | A | 10/1938 | Goodrie |
| 3,158,169 | A | 11/1964 | Smith |
| 3,894,302 | A | 7/1975 | Lasater |
| 4,811,431 | A | 3/1989 | Kraverath |
| 5,592,964 | A | 1/1997 | Traylor |
| 6,425,217 | B1 | 7/2002 | Furukawa |
| 6,684,415 | B1 | 2/2004 | Kozono |
| 7,290,557 | B1 | 11/2007 | Bowman |
| 7,880,300 | B2 | 2/2011 | Bauer |
| 2006/0026860 | A1 | 2/2006 | Blann |

FOREIGN PATENT DOCUMENTS

| | | | |
|---|---|---|---|
| DE | 1459584 | A1 | 11/1969 |
| EP | 0537896 | A1 | 4/1993 |
| FR | 1316714 | A | 2/1963 |

OTHER PUBLICATIONS

English Translation of FR 1,316,714; 1961.

*Primary Examiner* — Kevin R Barss
(74) *Attorney, Agent, or Firm* — Ralph E. Jocke; Walker & Jocke

(57) ABSTRACT

An anti-backflow plumbing fitting (10) includes an annular body (12) which bounds an interior area (20). The body includes a body outlet (28) and a plurality of cup portions (40) each of which includes an inlet opening (46). An annular body side wall (22) includes at least one radially extending side wall air gap (36). Each cup portion further includes a pair of angularly disposed cup air gaps (54). An inlet end wall (30) includes a plurality of body flow inlets (52) which are each associated with a respective cup portion. Each body flow inlet underlies a respective cup portion and is elongated in aligned relation with each cup air gap, to enable liquid to flow from the respective inlet opening of a cup portion into the interior area. The inlet end wall is sloped and includes a plurality of drain holes (66, 68) therein. A plurality of vanes (60) extend in the interior area intermediate of immediately adjacent body flow inlets.

28 Claims, 8 Drawing Sheets

ANTI-BACKFLOW PLUMBING FITTING

TECHNICAL FIELD

This disclosure relates to fittings through which liquid flow is conducted. Specifically, this disclosure relates to a plumbing fitting that enables flow from a liquid discharge device through the plumbing fitting in a direction toward a drain, while preventing backflow through the fitting toward the liquid discharge device.

BACKGROUND

Various types of devices used in commercial and residential facilities utilize or generate liquids that must be discharged to a drain. Many devices utilize or generate liquid water that is discharged to a drain which is connected to a sanitary or storm sewer system. Liquid discharge devices commonly found in commercial and residential facilities include sinks, drinking fountains, plumbing fixtures, water treatment devices, heaters, washers, dehumidifiers, humidifiers and air conditioners. Commercial facilities such as manufacturing and service facilities often include the same types of liquid discharge devices as are found in residential environments and may also include other types of liquid discharge devices that are needed to support the specific activities carried out at the facility. Such liquid discharge devices may include devices such as autoclaves, sterilizers, filters, deionizers, instrument cleaners, air compressors, spray cleaning systems and numerous other types of liquid discharge devices.

As liquid discharge devices are fluidly connected with a drain, there is a risk that the drain may become clogged or otherwise cease sufficiently rapid drain flow and that contaminated wastewater may backup into the device. For some devices the introduction of contaminated water may cause damage to the device and/or may pose serious health and safety issues.

Numerous devices and systems have been developed to prevent backflow of contaminated liquid from a drain to a liquid discharge device. Such devices and systems may benefit from improvements.

SUMMARY

Exemplary arrangements described herein include a plumbing fitting that prevents backflow of contaminated liquid from a drain to a liquid discharge device that is connected to the plumbing fitting. Exemplary arrangements further include a plumbing fitting that is configured to receive wastewater from a plurality of liquid discharge devices and to direct the wastewater from such devices through the fitting to a common outlet connected to a water drain.

Exemplary arrangements include a plumbing fitting with a plurality of air gaps in the path that the liquid takes through the device. These plurality of air gaps and other structural features enable flow in a discharge direction through the plumbing fitting and from an outlet thereof to the drain, while preventing backflow in an opposed backflow direction through the plumbing fitting. Numerous additional features of the exemplary plumbing fittings help to assure that the contaminated liquid cannot pass through the plumbing fitting to the liquid discharge device either from the drain or from other liquid discharge devices to which the plumbing fitting is connected. Exemplary fitting arrangements are configured to be readily visually inspected and cleaned.

DETAILED DESCRIPTION

Figure 1:
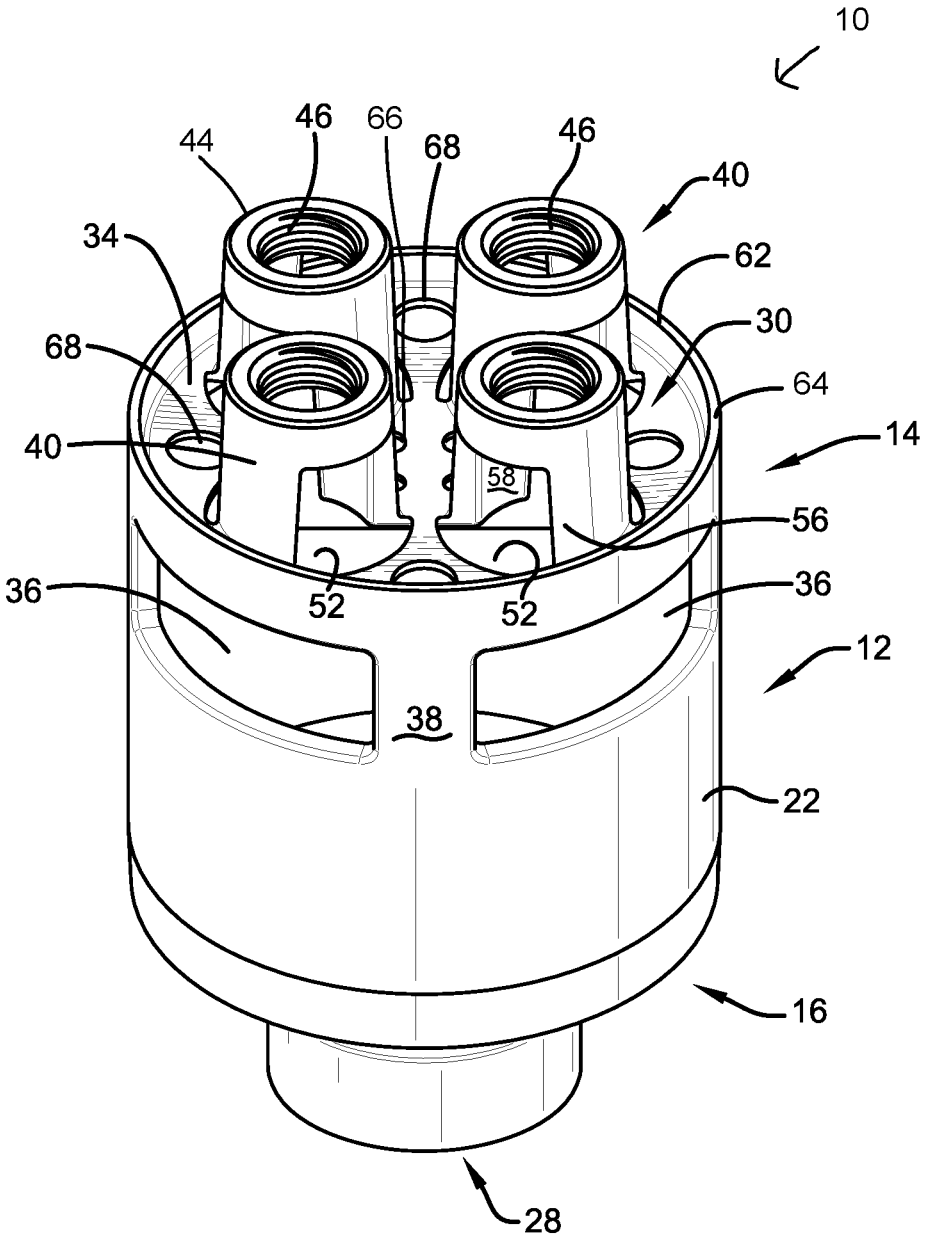
FIG. 1 is a front top perspective view of an anti-backflow plumbing fitting of an exemplary arrangement.

Referring now to the drawings and particularly to FIG. 1 there is shown therein an exemplary anti-backflow plumbing fitting generally indicated 10. The exemplary anti-backflow plumbing fitting includes an annular body 12. The annular body 12 includes an inlet end 14 and an outlet end 16 that is opposed of the inlet end. The exemplary body 12 extends along a central axis 18. In the operative position of the fitting, the axis extends vertically and with the inlet end 14 being vertically above the outlet end.

In the exemplary arrangement the body 12 bounds an interior area 20. The body includes an annular body side wall 22 which in the exemplary arrangement is cylindrical. In other arrangements other annular configurations may be used. At the outlet end 16 the interior area is bounded by an outlet end wall 24. The outlet end wall extends radially outward relative to the axis 18. The outlet end wall 24 includes an outlet end wall inner surface 26. The outlet end wall inner surface is in fluid tight relation with an inner surface 27 of the annular body side wall 22. The exemplary outlet end inner wall surface is tapered such that the outlet end inner wall surface is closer to the axis with increased distance away from the inlet end of the body. A body outlet 28 extends through the outlet end wall in axially centered relation. The body outlet 28 is configured to enable liquid to pass from the interior area 20 and to a drain in a manner like that later discussed.

The exemplary body further includes a radially extending inlet end wall 30. The inlet end wall 30 includes an inlet end wall inner surface 32 that bounds the interior area 20 at the inlet end 14. The inlet end wall 30 further includes an inlet end wall outer surface 34. The exemplary inlet end wall outer surface 34 is opposed of the inlet end wall inner surface 32, is exposed on the outside of the body and faces away from the interior area 20.

The exemplary annular body side wall extends intermediate of the inlet end wall 30 and the outlet end wall 24. At least one radially extending side wall air gap 36 extends in the annular body side wall 22. The at least one side wall air gap 36 extends into the interior area and provides for the interior area to be open to atmosphere. In the exemplary arrangement the body includes a plurality of side wall air gaps 36 in the annular body side wall. Each of the side wall air gaps 36 extends axially and circumferentially in the body side wall and is separated from the immediately adjacent side wall air gaps by extending portions 38 of the annular body side wall. The exemplary side wall air gaps 36 are axially disposed more closely to the inlet end wall 30 than to the outlet end wall 24. This exemplary configuration of the side wall air gaps enables accumulation of a larger volume of liquid in the interior area 20 before the level of the liquid rises to the height of the side wall air gaps 36 and flows outward from the body. In the exemplary arrangement the side wall air gaps 36 occupy circumferentially more than half of the total circumference of the body side wall 22 and are one inch or more in length along the axial direction. This enables the flow of air and the discharge of liquid through the air gaps at a substantial flow rate. Of course it should be understood that this configuration is exemplary and other arrangements other configurations may be used.

The exemplary fitting body further includes a plurality of cup portions 40. While in the exemplary arrangement shown the fitting includes four cup portions, other arrangements may include one or more cup portions. The exemplary cup portions comprise a liquid container, vessel or conduit that extends above the interior area during operation and serves to house and pass liquid therethrough. Each cup portion extends outside the interior area and away from the inlet end wall outer surface 34 along a respective cup direction 42 that for each cup portion is parallel to the axis 18. Each cup portion 40 is in supported connection with the inlet end wall 30 and terminates outwardly at a respective cup end wall 44. Each cup end wall 44 includes an inlet opening 46 therethrough. Each inlet opening 46 is configured to receive a fitting or other connector through which liquid from a liquid discharge device is enabled to flow into the fitting.

In the exemplary arrangement each cup portion 40 includes an annular cup side wall 48. Each cup side wall 48 bounds a cup passage 50. Each cup passage 50 fluidly extends from the respective inlet opening 46 of the respective cup portion to a respective body flow inlet 52. Each body flow inlet extends through the inlet end wall 32 to the interior area 20. In the exemplary arrangement each body flow inlet 52 is positioned such that a centerline along the respective cup direction thereof is vertically aligned above the outlet end wall inner surface 26 in the operative position of the fitting. The exemplary arrangement includes four angularly spaced cup portions 40, and the inlet end wall includes four corresponding angularly spaced body flow inlets 52. Of course it should be understood that this configuration is exemplary and in other arrangements other numbers of cup portions and other configurations may be used.

Each cup side wall 48 of each exemplary cup portion is angularly tapered. The tapered configuration of the exemplary arrangement causes the cup side wall to extend further outwardly transversely of the respective direction 42 of the respective cup portion 40 with proximity to the inlet end wall outer surface 34. In the exemplary arrangement the tapered cup side wall 48 includes at least one cup side wall air gap 54. Each cup air gap 54 extends transversely of the direction 42 and connects the cup passage 50 with atmosphere.

In the exemplary arrangement each cup portion 40 has a cup side wall that is comprised of a plurality of angularly disposed and separated cup leg portions 56 which have cup side wall air gaps intermediate thereof. Each cup leg portion is operatively connected to the inlet end wall outer surface 34. In the exemplary arrangement shown the cup side wall 48 includes a pair of angularly disposed cup leg portions 56. Each of the cup leg portions are radially aligned relative to the axis 18. Each of the disposed cup leg portions include a cup leg portion inside face 58 that bounds the respective cup passage 50. A pair of cup air gaps 54 extend angularly between immediately angularly adjacent cup leg portions. In the exemplary arrangement the pair of cup air gaps occupy circumferentially more than half of the circumference of the cup side wall 48 in the area where the cup air gaps 54 are positioned, and the exemplary cup air gaps extend along the direction 42 at least one inch. Of course it should be understood that this configuration is exemplary and in other arrangements other configurations may be used.

Figure 6:
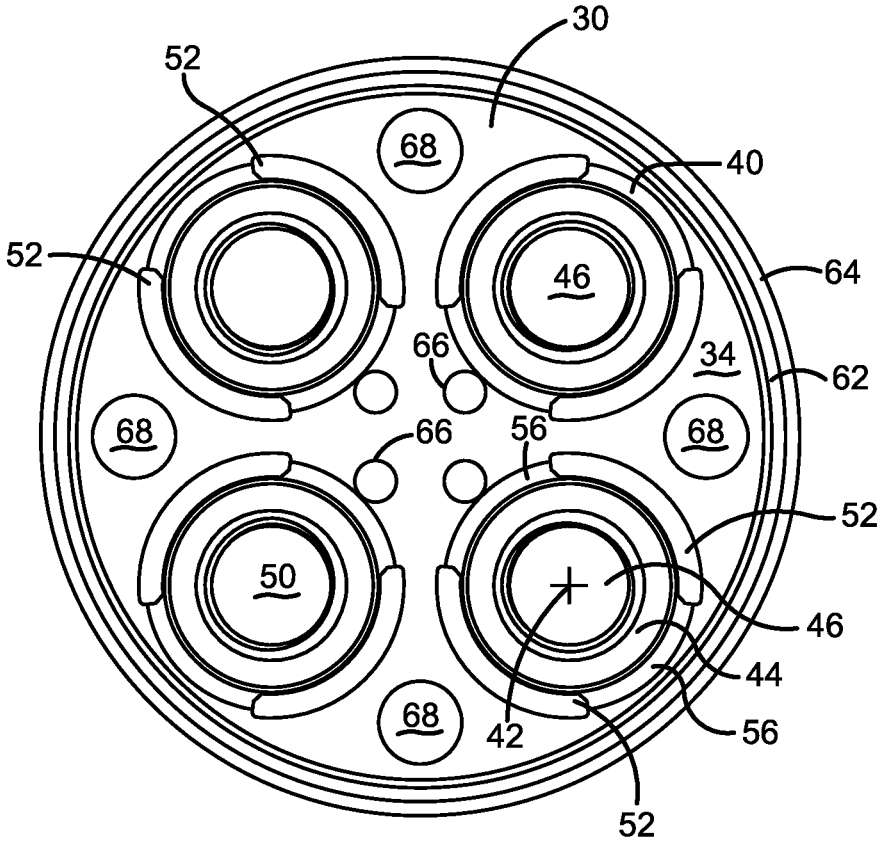
FIG. 6 is a top view of the exemplary plumbing fitting.
Figure 7:
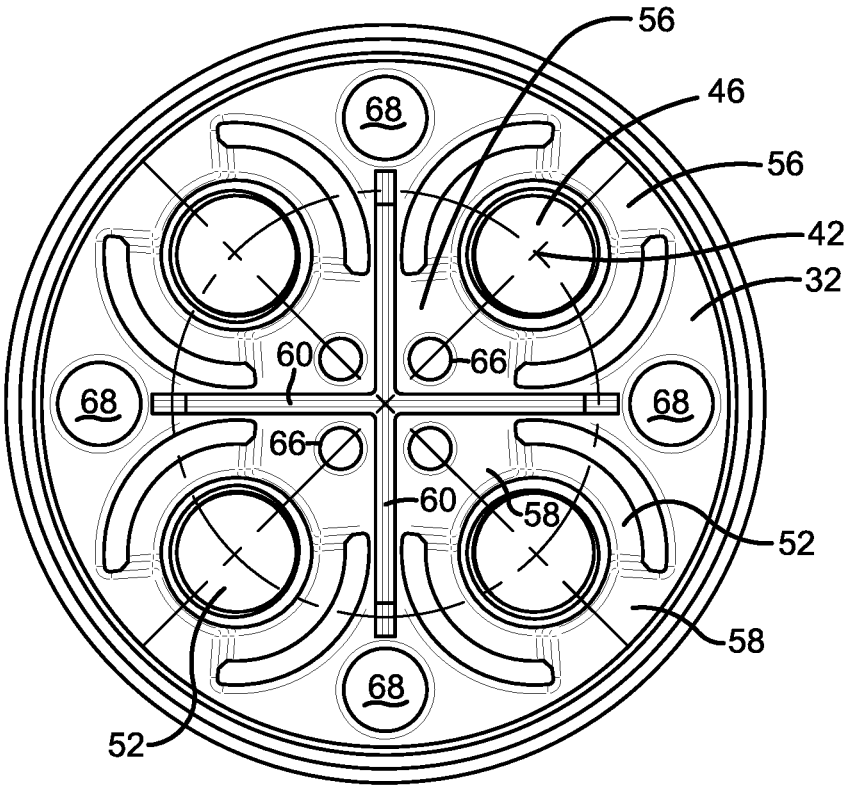
FIG. 7 is a bottom view of the inlet end wall inner surface of the exemplary plumbing fitting.

As best shown in FIGS. 6 and 7, each body flow inlet 52 extends through the inlet end wall 30 in underlying relation of a respective cup portion 40. Each body flow inlet 52 is operative to pass liquid that is received through the respective inlet opening 46 and that flows through the cup passage 50, into the interior area 20. The exemplary body flow inlets 52 are configured so as to extend transverse to the direction 42 of the respective cup portion and to extend intermediate of the cup leg portions 56 at the level of the inlet end wall outer surface 34. Further in exemplary arrangements the body flow inlets 52 are configured to extend transverse of the direction 42 outwardly beyond each cup leg portion inside face 58 in aligned relation with each of the cup air gaps 54. As a result in the exemplary arrangement body flow inlets 52 associated with a respective cup portion 40 extend transversely of the direction outwardly beyond the cup leg portions 56 in the inlet end wall 30. This configuration adds more open area to that provided by the cup air gaps 54 of each respective cup portion 40. Of course it should be understood that this configuration is exemplary and in other arrangements other configurations may be used.

Figure 8:
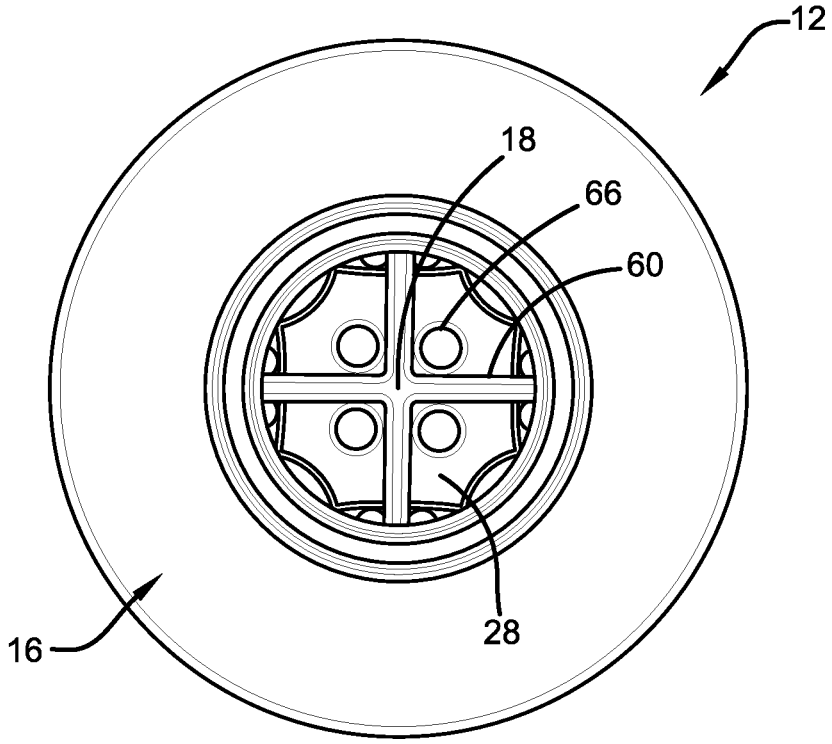
FIG. 8 is a bottom view of the exemplary plumbing fitting.

In the exemplary arrangement radially extending vanes 60 extend on the inlet end wall inner surface 32. In the exemplary arrangement vanes 60 extend from the inlet end wall inner surface toward the outlet end 16 of the body. The exemplary vanes 60 extend angularly intermediate of each immediately angularly adjacent pair of cup portions 40 and body flow inlets. As can be seen in FIGS. 7 and 8 the exemplary vanes 60 form an X-shape that is centered at the axis 18. The exemplary vanes are positioned to extend radially outward from the axis and angularly between the immediately adjacent body flow inlets 52 in the interior area. This configuration reduces the risk that contaminated liquid from one liquid discharge device that enters the interior area 20 through one of the cup portions, comes into contact with or flows into a cup portion that is connected to a different liquid discharge device. Further in the exemplary arrangement the vanes 60 extend toward the outlet end 16 a distance that extends to about half the height of the side wall air gaps 36. Of course this configuration is exemplary and in other arrangements other configurations may be used.

In the exemplary arrangement a continuous annular ring projection 62 extends in concentric relation with the axis, and in surrounding relation of the inlet end wall outside surface 34. The annular ring projection 62 also is disposed radially outward of each of the cup portions 40. The exemplary annular ring projection 62 extends parallel to the axis and outwardly away from the inlet end wall outside surface 34, and terminates outward at a top rim 64. In the exemplary arrangement the top rim 64 is not disposed in the axial direction as far outwardly from the inlet end wall outer surface as the cup end walls 44 of the cup portions 40. Further in the exemplary arrangement the annular ring projection extends in aligned relation with the annular body side wall 22 so as to provide a continuation thereof outwardly and above the inlet end wall 30 when the fitting is in the operative position. In the exemplary arrangement the annular rim projection 62 is in fluid tight connection with the inlet end wall outside surface 34 and serves to hold any liquid on the inlet end wall outer surface 34 which may pass outward onto the surface from the cup passages 52 through the cup air gaps 54. Of course it should be understood that this configuration is exemplary of structures that may be used for holding liquid on the outside surface of the body, and in other arrangements different structures may be used.

In the exemplary configuration the inlet end wall outside surface 34 is sloped such that the surface is closer to the outlet end 16 with increased proximity to the axis 18. In the exemplary arrangement the inlet end wall outside surface is conically sloped toward the axis such that liquid will tend to move by gravity toward an axially central area of the surface. At least one central drain hole 66 extends through the inlet end wall 30. In the exemplary arrangement four central drain holes 66 extend through the inlet end wall. Each of the central drain holes 66 are positioned angularly intermediate of the immediately adjacent vanes 60. Thus in the exemplary arrangement liquid on the inlet end wall outer surface 34 is urged to flow toward the central drain holes 66 and is enabled to pass into the interior area 20 therethrough. Further in the exemplary arrangement the central drain holes 66 further connect the interior area 20 with atmosphere to enhance the capability of providing air and liquid flow between the interior area 20 and the adjacent environment as also provided by the side wall air gaps 36. The exemplary inlet end wall 30 further includes a plurality of peripheral drain holes 68 that extend therethrough. In the exemplary arrangement each of the peripheral drain holes 68 are angularly intermediate of each pair of immediately adjacent cup portions 40 and body flow inlets. The peripheral drain holes in the exemplary arrangement are disposed radially inward from the annular ring projection 62 on the inlet end wall outside surface 34. Further as shown in FIG. 7 each of the peripheral drain holes is in radially aligned relation with a respective vane 60 in the interior area. As can be appreciated in this exemplary arrangement the peripheral drain holes 68 are angularly intermediate of the cup air gaps 54 of the immediately angularly adjacent cup portions 40. Thus this configuration further facilitates connecting the interior area 20 to atmosphere, and also helps in directing liquid that may pass from the cup air gaps 54 onto the surface 34 to move by gravity through the peripheral drain holes and into the interior area 20. The drain holes 66, 68 further help to prevent drawing liquid by vacuum into the cup portions. Of course it should be understood that this configuration is exemplary and in other arrangements other configurations may be used.

Figure 2:
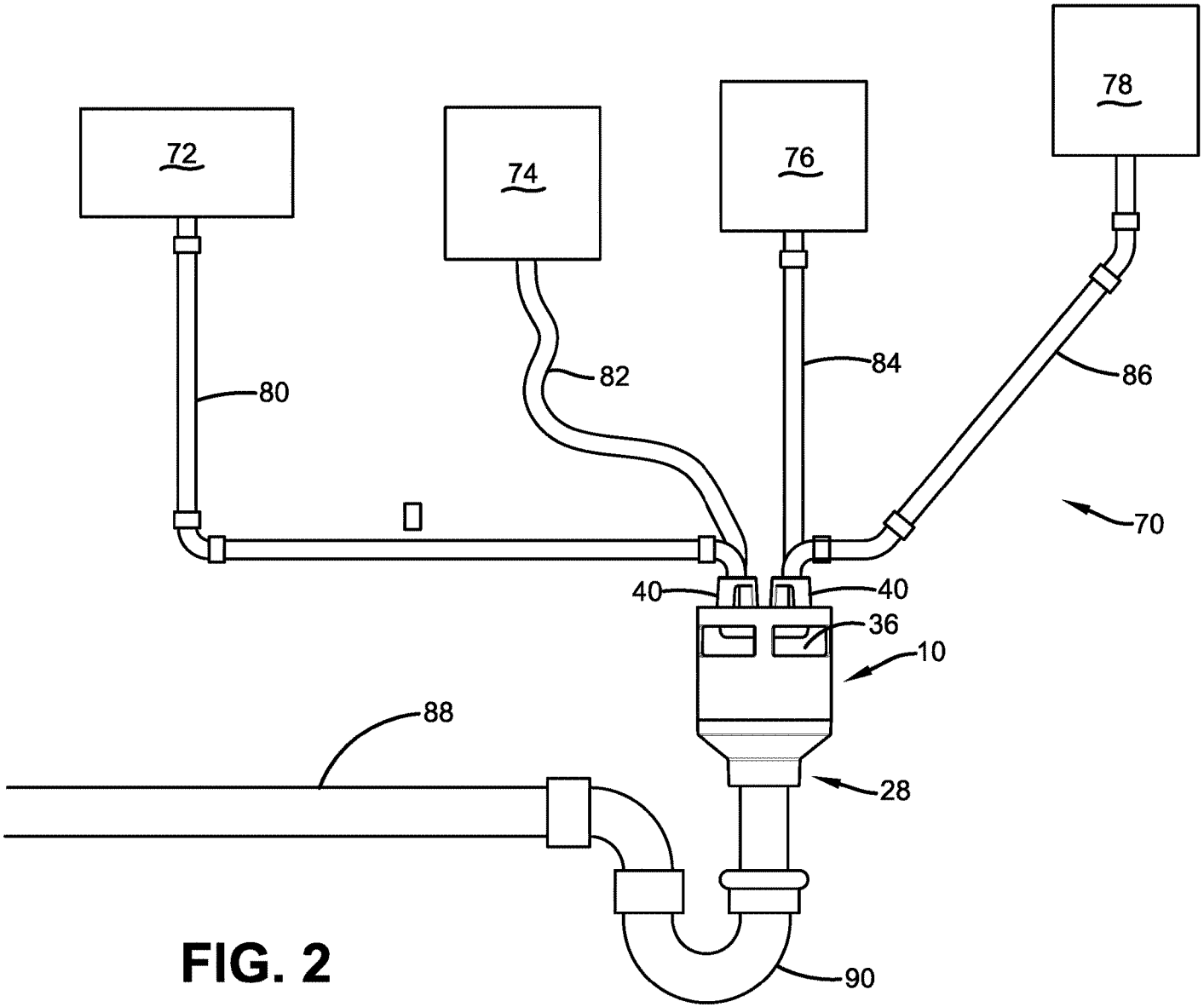
FIG. 2 is a schematic view of a system including a plurality of liquid discharge devices including the exemplary anti-backflow plumbing fitting.
Figure 3:
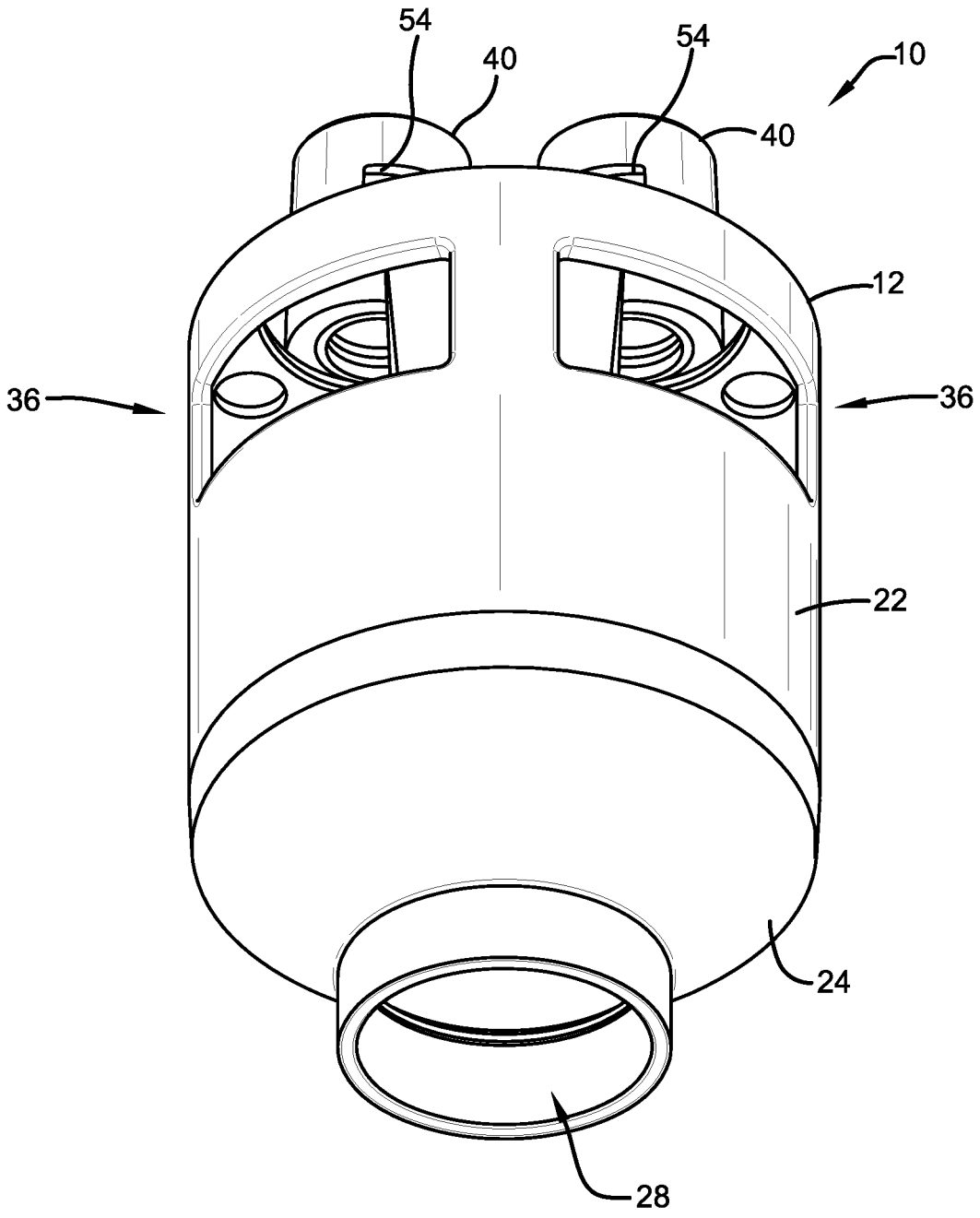
FIG. 3 is a bottom perspective view of the exemplary plumbing fitting.
Figure 4:
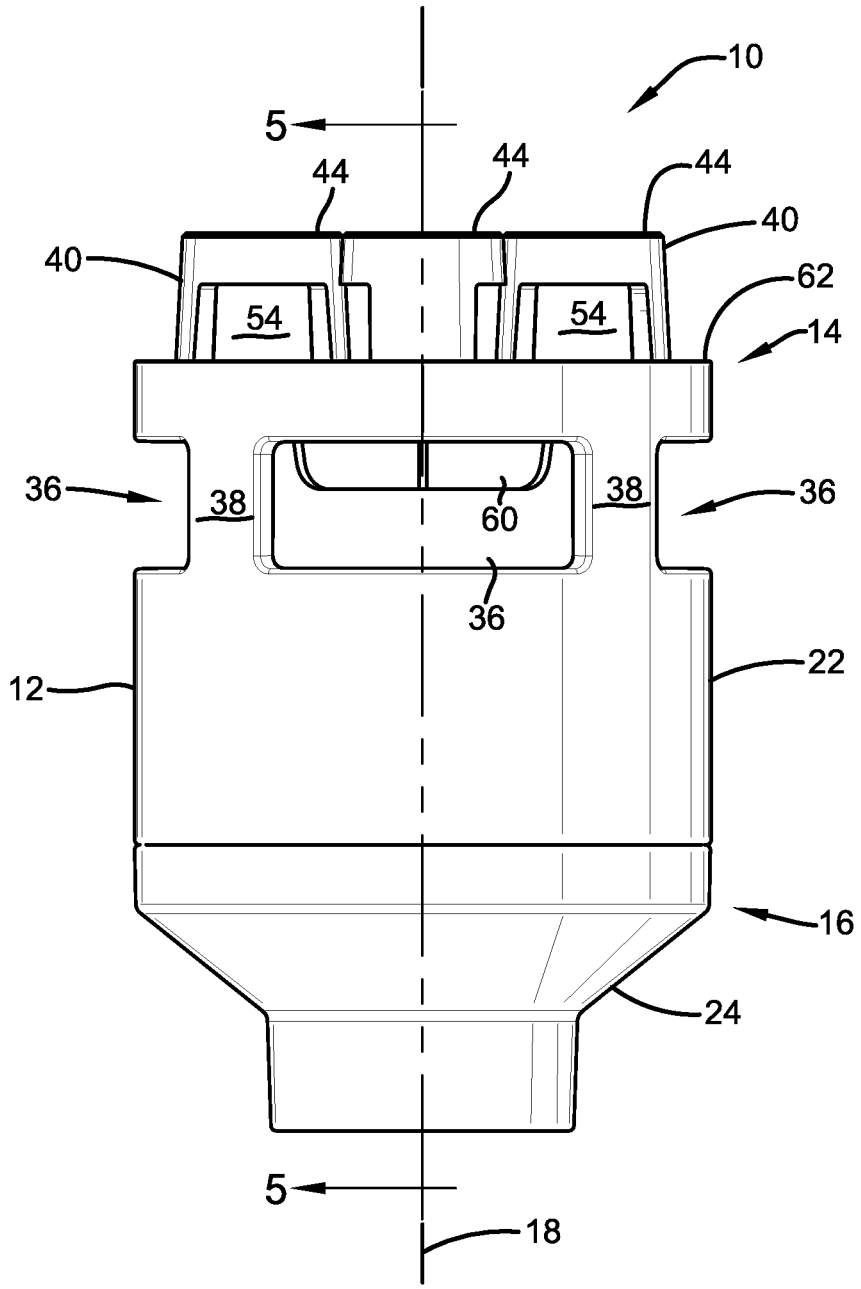
FIG. 4 is a right side view of the exemplary plumbing fitting.

FIG. 2 shows schematically an exemplary system 70 in which the exemplary anti-backflow plumbing fitting 10 is employed. System 70 includes four liquid discharge devices 72, 74, 76 and 78. The exemplary liquid discharge devices are operative to each discharge wastewater therefrom. The liquid discharge devices 72, 74, 76, 78 are each fluidly connected through respective fluid conduits 80, 82, 84 and 86 to the anti-backflow plumbing fitting 10. As represented in FIG. 2 the fluid conduits may be of various types including rigid pipes, flexible hoses or tubing or other suitable conduit types. Further the fluid conduits may include suitable valves, fittings or other connectors and components so as to conduct the wastewater from the respective device to the fitting 10. Further in other exemplary arrangements the wastewater outlets from a plurality of devices may be connected together through suitable fittings so as to form a single conduit that connects to the fitting 10. Of course it should be understood that the exemplary fitting 10 includes four inlet openings and the exemplary system 70 includes four liquid discharge devices. However, the exemplary fitting 10 may be used in systems that have fewer than four liquid discharge devices. In such circumstances the inlet openings 46 on the fitting 10 that are not needed may be left open and unused. Further as previously discussed, exemplary arrangements of anti-backflow plumbing fittings may include one or more inlet openings 46 or may include a larger number of cup portions and inlet openings than the four shown in the exemplary arrangement. Thus anti-backflow plumbing fittings of various configurations may be utilized in numerous different types of systems including different numbers of liquid discharge devices.

As shown in FIG. 2 each respective fluid conduit is connected to the inlet opening 46 of respective cup portion 40 of the fitting 10. The body outlet 28 of the fitting is fluidly connected to a drain through a drain line 88. The exemplary drain line 88 includes a drain trap 90 vertically below the anti-backflow fitting 10 so as to maintain water in the trap and reduce the risk that sewer gas from the drain will migrate above the trap and into the facility in which the fitting 10 is located. The exemplary body outlet is fluidly connected to a nipple that extends axially outward on the body. The exemplary nipple is sized so that a larger drain line may accept an external annular surface of the nipple in fluid tight close fitting relation therein. Further the internal annular surface of the nipple is sized so that an external annular surface of a smaller drain line may be accepted in fluid tight close fitting relation therein, thus allowing the fitting to be used with drain lines of different sizes. Of course it should be understood that this drain configuration is exemplary and that other drain configurations may be utilized in connection with exemplary anti-backflow fittings.

In operation of the exemplary system water which is discharged from the liquid discharge devices 72, 74, 76 and 78 is passed through the respective fluid conduits 80, 82, 84 and 86 and into the interior area 20 of the anti-backflow plumbing fitting. The wastewater is contained by the fitting and passes from the interior area 20 thereof through the body outlet 28 and into the drain line 88 from which the wastewater passes into a suitable drain. In the event that wastewater in the drain line 88 begins to backup toward the fitting, or wastewater from the liquid discharge devices is not carried away through the body outlet quickly enough, the wastewater will pass out of the interior area through side wall air gaps 36, central drain holes, peripheral drain holes and cup air gaps 54. The ability of the fitting to enable substantial air flow and wastewater flow out of the fitting through its plurality of openings reduces the risk of backflow from the drain line or the interior of the fitting into any of the wastewater fluid conduits connected to the liquid discharge devices. Further the exemplary configuration reduces the risk of liquid discharge devices drawing liquid from the fitting to the device if the device should draw a vacuum on its respective fluid conduit. This configuration reduces the risk of damage or contamination as a result of wastewater backflow coming into contact with any of the liquid discharge devices.

Figure 5:
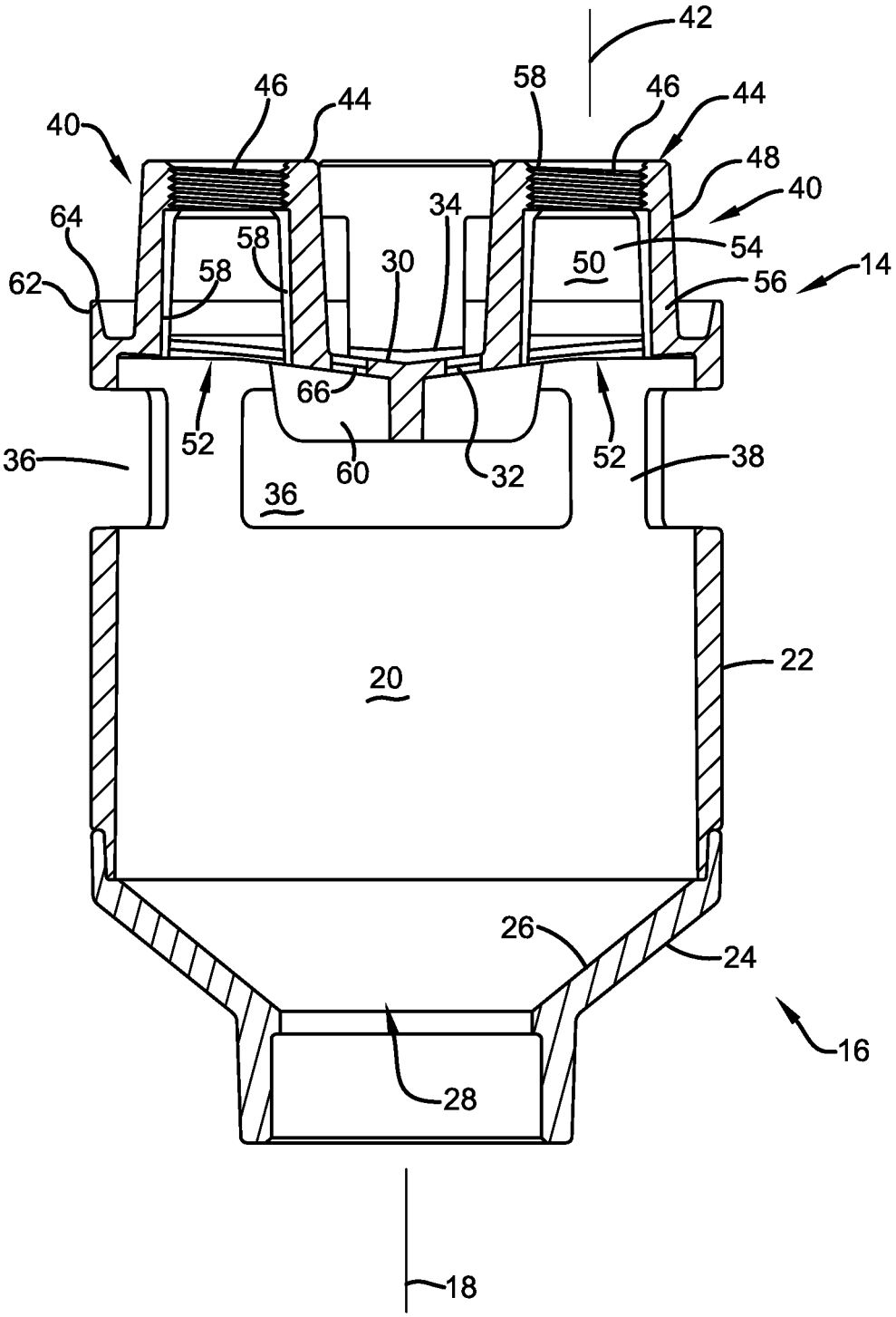
FIG. 5 is a cross-sectional view along line 5-5 in FIG. 4.

Further it should be understood that the configuration of the fitting 10 is exemplary. As previously discussed other arrangements that employ the principles discussed herein may include one, two, three, four or more cup portions and liquid inlets. Further other arrangements may not have the cup portions and inlets angularly disposed on the body but instead may have other configurations. Further exemplary fitting arrangements may have configurations other than the substantially cylindrical body arrangement described herein. Further as can be appreciated, the exemplary fitting arrangement is configured such that the fitting is comprised of an assembly which includes the outlet end wall 24 which includes the tapered outlet end wall inner surface 26 and body outlet 28 as a single piece that is joined through an annular fluid tight joint 92 with the annular body side wall 22 as shown in FIG. 5. This enables the body component including outlet end wall 24 to be utilized in conjunction with different components to provide anti-backflow fittings which include different numbers and configurations of cup portions and vane structures. Of course this approach to facilitate the manufacture of different fitting configurations is exemplary, and in other arrangements other approaches may be used.

Thus the exemplary arrangements of the anti-backflow plumbing fitting described herein achieve improved operation, eliminate difficulties encountered in the use of prior devices and systems, and attain useful results that have been described herein.

In the foregoing description, certain terms have been used for brevity, clarity and understanding. However, no unnecessary limitations are to be implied therefrom because such terms are used for descriptive purposes and are intended to be broadly construed. Moreover the descriptions and illustrations herein are by way of examples and the new and useful features are not limited to the exact features and configurations shown and described.

Further it should be understood that the features and/or relationships associated with one arrangement can be combined with features and/or relationships from another arrangement. That is, various features and/or relationships from various arrangements described herein can be combined in further arrangements, and the inventive scope of the disclosure is not limited to only the arrangements that have been shown or described herein.

Having described features, discoveries and principles of the exemplary arrangements, the manner in which they are constructed and operated, and the advantages and useful results attained; the new and useful features, devices, elements, arrangements, parts, combinations, systems, equipment, operations, methods, processes and relationships are set forth in the appended claims.

I claim:

1. Apparatus comprising:

an anti-backflow plumbing fitting, including an annular body, wherein the body bounds an interior area, wherein in the operative position the body extends along a vertically extending central axis, wherein the body includes an inlet end and an outlet end, wherein the inlet end is axially opposed of the outlet end, a radially extending outlet end wall, wherein the outlet end wall includes an outlet end wall inner surface, wherein the outlet end wall inner surface bounds the interior area at the outlet end, a body outlet, wherein the body outlet extends through the outlet end wall and is configured to enable liquid to pass out of the interior area through the body outlet to a drain, a radially extending inlet end wall, wherein the inlet end wall includes an inlet end wall inner surface, wherein the inlet end wall inner surface bounds the interior area at the inlet end, an inner end wall outer surface, wherein the inlet end wall outer surface is opposed of the inlet end wall inner surface and is outside the interior area, at least one body flow inlet, wherein the at least one body flow inlet extends through the inlet end wall to the interior area, an annular body side wall, wherein the annular body side wall includes an annular body side wall inner surface, wherein the annular body side wall inner surface bounds the interior area, extends axially intermediate of the outlet end wall inner surface and the inlet end wall inner surface, is in operative fluid tight connection with the outlet end wall inner surface, and is positioned radially outward from the body outlet, wherein the annular body side wall further includes at least one radially extending body side wall air gap, wherein the interior area is open to atmosphere through the at least one body side wall air gap, at least one cup portion, wherein each cup portion is in operatively supported connection with the inlet end wall, and extends outside the interior area, away from the inlet end wall outer surface along a direction parallel to the axis, wherein each cup portion includes a cup end wall, wherein the cup end wall is disposed along the direction away from the inlet end wall outer surface and has an inlet opening therethrough, wherein the inlet opening is configured to receive liquid from a liquid discharge device into the cup portion, a cup annular side wall, wherein the cup annular side wall extends intermediate of the cup end wall and the inlet end wall outer surface, bounds a cup passage, wherein the cup passage extends along the direction and fluidly between the inlet opening and a respective body flow inlet, and includes at least one cup side wall air gap, wherein the cup passage is open to atmosphere through the at least one cup side wall air gap.

2. The apparatus according to claim 1 wherein the body further includes a continuous annular ring projection, wherein the annular ring projection extends extends concentric with the axis and outwardly away from the inlet end wall outer surface, and is disposed radially outwardly away from each at least one cup portion.

3. The apparatus according to claim 2 wherein each cup side wall includes a plurality of angularly separated cup leg portions, wherein each cup leg portion is in operative connection with the inlet end wall outer surface, wherein the at least one cup side wall air gap extends angularly between each immediately angularly adjacent pair of cup leg portions, wherein the respective body flow inlet extends transverse of the direction and intermediate of the cup leg portions.

4. The apparatus according to claim 3
wherein each cup side wall is angularly tapered,
wherein each cup side wall extends further outwardly transversely to the direction with closer proximity to the inlet end wall outside surface.

5. The apparatus according to claim 4
wherein the inlet end wall outside surface is sloped such that the inlet end wall outside surface is closer to the outlet end of the body with closer proximity to the axis,
wherein the inlet end wall includes at least one central drain hole, wherein the at least one central drain hole extends through the inlet end wall and extends closer to the axis than each body flow inlet.

6. The apparatus according to claim 5
wherein the at least one cup portion comprises a plurality of cup portions,
wherein the body further includes
at least one vane, wherein the at least one vane extends from the inlet end wall inner surface toward the outlet end, and intermediate of respective body flow inlets of two immediately adjacent cup portions.

7. The apparatus according to claim 6
wherein the cup portions are angularly spaced from one another about the axis,
wherein the at least one vane extends radially outward from the axis and angularly intermediate of each immediately adjacent pair of body flow inlets,
at least one central drain hole, wherein each central drain hole extends through the inlet end wall,
wherein each central drain hole extends radially closer to the axis than each of the body flow inlets and is angularly disposed away from each immediately adjacent vane.

8. The apparatus according to claim 7
wherein the body further includes at least one peripheral drain hole,
wherein each peripheral drain hole extends through the inlet end wall,
wherein each peripheral drain hole is disposed angularly intermediate of a pair of immediately adjacent body flow inlets.

9. The apparatus according to claim 8
wherein each peripheral drain hole is angularly aligned with a respective vane.

10. The apparatus according to claim 9
wherein the at least one radially extending side wall air gap extends both axially and circumferentially in the annular body side wall,
wherein the side wall air gap occupies circumferentially more than half of the annular body side wall.

11. The apparatus according to claim 10
wherein the outlet end inner wall surface is tapered such that the outlet inner wall surface is closer to the axis with the increasing distance away from the inlet end of the body.

12. The apparatus according to claim 11
wherein the plurality of cup portions includes at least three cup portions,
wherein each cup side wall includes
a pair of angularly separated cup leg portions, wherein each cup leg portion is in operative connection with the inlet end wall outer surface,
wherein the at least one cup side wall air gap includes a pair of angularly spaced air gaps that extend angularly between the pair of cup leg portions, wherein the pair of angularly spaced air gaps circumferentially occupy more than half of the cup side wall,
wherein each leg portion of the pair of cup leg portions is radially aligned relative to the axis, and
wherein the respective body flow inlet of the respective cup portion extends transverse of the direction and intermediate of the cup leg portions.

13. The apparatus according to claim 1
wherein the body further includes
a continuous annular ring projection, wherein the annular ring projection
extends concentric with the axis and outwardly away from the inlet end wall outer surface parallel to the axis,
is disposed radially outwardly away from each at least one cup portion, and
in aligned relation with the annular body side wall.

14. The apparatus according to claim 1
wherein the body further includes
a continuous annular ring projection, wherein the annular ring projection
extends concentric with the axis and disposed radially outwardly away from each at least one cup portion,
extends outwardly away from the inlet end wall outer surface, wherein the annular ring projection terminates outwardly at a top rim, wherein the cup end wall of the at least one cup portion is disposed further away in the axial direction from the inlet end wall outer surface than the top rim.

15. The apparatus according to claim 1
wherein each cup side wall includes
a plurality of angularly separated cup leg portions, wherein each cup leg portion is in operative connection with the inlet end wall outer surface,
wherein a respective cup side wall air gap extends angularly between each immediately angularly adjacent pair of cup leg portions,
wherein the respective body flow inlet extends transverse of the direction and intermediate of the cup leg portions.

16. The apparatus according to claim 1
wherein each cup side wall includes
a pair of angularly separated cup leg portions, wherein each cup leg portion is in operative connection with the inlet end wall outer surface,
wherein the at least one cup side wall air gap includes a pair of angularly spaced air gaps that extend angularly between the pair of cup leg portions, wherein the pair of angularly spaced air gaps circumferentially occupy more than half of the cup side wall,
wherein each of the pair of cup leg portions is radially aligned relative to the axis, and
wherein the respective body flow inlet of the respective cup portion extends transverse of the direction and intermediate of the cup leg portions.

17. The apparatus according to claim 1
wherein each cup side wall includes
a plurality of angularly separated cup leg portions, wherein each cup leg portion
includes a cup leg portion inside face, wherein each cup leg portion inside face bounds the respective cup passage, and
is in operative connection with the inlet end wall outer surface,
wherein a respective cup side wall air gap extends along the direction and angularly between each immediately angularly adjacent pair of cup leg portions,
wherein the respective body flow inlet extends transverse of the direction and intermediate of the cup leg portions, and in aligned relation with each cup side wall air gap, transverse of the direction and outwardly beyond each cup leg portion inside face.

18. The apparatus according to claim 1 wherein each cup side wall is angularly tapered, wherein each cup side wall extends further outwardly transversely to the direction with closer proximity to the inlet end wall outside surface.

19. The apparatus according to claim 1 wherein the inlet end wall outside surface is sloped such that the inlet end wall outside surface is closer to the outlet end of the body with closer proximity to the axis, wherein the inlet end wall includes at least one central drain hole, wherein the at least one central drain hole extends through the inlet end wall and extends closer to the axis than each body flow inlet.

20. The apparatus according to claim 1 wherein the at least one cup portion comprises a plurality of cup portions, wherein the body further includes at least one vane, wherein the at least one vane extends from the inlet end wall inner surface toward the outlet end, and intermediate of respective body flow inlets of two immediately adjacent cup portions.

21. The apparatus according to claim 1 wherein the at least one cup portion comprises a plurality of cup portions, wherein the cup portions are angularly spaced about the axis, wherein the body further includes at least one vane, wherein the at least one vane extends from the inlet end wall inner surface toward the outlet end, and wherein at least one vane extends angularly intermediate of each immediately adjacent pair of body flow inlets.

22. The apparatus according to claim 1 wherein the at least one cup portion comprises a plurality of cup portions, wherein the cup portions are angularly spaced about the axis, wherein the body further includes at least one vane, wherein the at least one vane extends from the inlet end wall inner surface toward the outlet end, and wherein at least one vane extends radially outwardly from the axis and angularly intermediate of each immediately adjacent pair of body flow inlets.

23. The apparatus according to claim 1 wherein the at least one cup portion comprises a plurality of cup portions, wherein the cup portions are angularly spaced about the axis, wherein the body further includes at least one vane, wherein the at least one vane extends from the inlet end wall inner surface toward the outlet end, and wherein at least one vane extends radially outwardly from the axis and angularly intermediate of each immediately adjacent pair of body flow inlets, at least one central drain hole, wherein each central drain hole extends through the inlet end wall, wherein each central drain hole extends radially closer to the axis than each of the body flow inlets and is angularly disposed away from each immediately adjacent vane.

24. The apparatus according to claim 1 wherein the at least one cup portion comprises a plurality of cup portions, wherein the cup portions are angularly spaced from one another about the axis, wherein the body further includes at least one vane, wherein the at least one vane extends from the inlet end wall inner surface toward the outlet end, and wherein at least one vane extends radially outwardly from the axis and angularly intermediate of each immediately adjacent pair of body flow inlets, at least one peripheral drain hole, wherein the at least one peripheral drain hole extends through the inlet end wall and is radially aligned with a respective vane.

25. Apparatus comprising:

an anti-backflow plumbing fitting, including a body, wherein the body bounds an interior area within the body, wherein the body includes an annular body side wall, wherein the annular body side wall bounds the interior area, wherein the body includes an inlet end, wherein at the inlet end the interior area is bounded by an inlet end wall, wherein the inlet end wall includes a plurality of spaced apart body flow inlets, wherein each body flow inlet extends through the inlet end wall to the interior area, wherein the body includes an outlet end opposed of the inlet end, wherein at the outlet end the interior area is bounded by an outlet end wall, wherein the outlet end wall includes a body outlet that extends through the outlet end wall, wherein the body outlet is configured to be connected to a liquid drain, wherein in the operative position of the fitting the inlet end wall extends vertically above the body outlet, wherein the annular body wall includes at least one annular side wall air gap, wherein the at least one side wall air gap is positioned intermediate of the inlet end wall and the outlet end wall, wherein the interior area is open to atmosphere through the at least one side wall air gap, wherein the body further includes a plurality of cup portions, wherein each cup portion outwardly overlies a respective body flow inlet, wherein each cup portion terminates outwardly away from the respective body flow inlet at a respective cup end wall, wherein each cup end wall includes a respective inlet opening configured to receive liquid from a liquid discharge device, wherein each cup portion includes a respective annular cup side wall, wherein each annular cup side wall extends intermediate of the respective cup end wall and the inlet end wall, and bounds a respective cup passage, wherein the cup passage extends fluidly between the respective inlet opening and respective body flow inlet, includes at least one respective cup side wall air gap, wherein the respective cup passage is open to atmosphere through the at least one cup side wall air gap.

26. The apparatus according to claim 25 wherein the body further includes a continuous ring projection, wherein the continuous ring projection extends outwardly away from the inlet end wall and in surrounding relation of all of the plurality of body flow openings, at least one drain hole that extends through the inlet end wall, wherein the at least one drain hole is disposed from each of the cup portions, and wherein the continuous ring projection extends in surrounding relation of the at least one drain hole, whereby liquid that passes out of the at least one cup side wall air gap of a respective cup portion is held on top of the inlet end wall by the continuous ring projection and is enabled to pass into the interior area through the at least one drain hole.

27. The apparatus according to claim 26 wherein the inlet end wall includes at least one vane, wherein the at least one vane extends from the inlet end wall in the interior area toward the outlet end wall, and intermediate of each immediately adjacent pair of body flow inlets.

28. The apparatus according to claim 27 wherein the body extends along a central axis, wherein the central axis extends vertically in the operative position of the fitting, wherein the plurality of cup portions are angularly spaced about the central axis, wherein each cup portion includes a pair of angularly spaced cup leg portions, wherein each cup leg portion includes a respective cup inside face, wherein the inside face of each cup leg portion bounds the cup passage through the respective cup portion, and wherein the cup leg portions are radially aligned relative to the axis, a pair of cup air gaps, wherein the cup air gaps extend angularly between the cup leg portions, wherein the pair of air gaps circumferentially occupy more than half of the cup side wall, wherein the respective body flow inlet extends in the inlet end wall transversely outwardly beyond the respective cup passage in aligned relation with each of the pair of cup air gaps.

* * * * *